US006292958B1

(12) United States Patent
Benne et al.

(10) Patent No.: US 6,292,958 B1
(45) Date of Patent: Sep. 25, 2001

(54) INFLOW AND DRAIN FIXTURE FOR BATHTUBS OR SHOWER TUBS

(75) Inventors: David Benne; Maarten Röst, both of Jona (CH)

(73) Assignee: Gerberit Technik AG, Jona (CH)

( * ) Notice: Subject to any disclaimer, the term of this patent is extended or adjusted under 35 U.S.C. 154(b) by 0 days.

(21) Appl. No.: 09/648,795

(22) Filed: Aug. 28, 2000

(30) Foreign Application Priority Data

Aug. 27, 1999 (CH) ..... 1578/99

(51) Int. Cl.[7] ..... E03C 1/00
(52) U.S. Cl. ..... 4/674; 4/678
(58) Field of Search ..... 4/671, 674, 678

(56) References Cited

U.S. PATENT DOCUMENTS

| | | | | |
|---|---|---|---|---|
| 399,691 | * | 3/1889 | Newell | 4/674 |
| 1,427,567 | * | 8/1922 | Yeiser | 4/674 |
| 1,466,895 | * | 9/1923 | Edelman | 4/674 |
| 1,658,159 | * | 2/1928 | Ernst et al. | 4/674 X |
| 1,994,789 | * | 3/1935 | Redmond et al. | 4/674 X |
| 6,219,858 | * | 4/2001 | Farmer | 4/674 |

FOREIGN PATENT DOCUMENTS

| | | |
|---|---|---|
| 196 04 760 | 11/1996 | (DE) . |
| 196 49 937 | 6/1998 | (DE) . |
| 0 731 222 | 9/1996 | (EP) . |
| 8-261567 | 10/1996 | (JP) . |

* cited by examiner

*Primary Examiner*—Robert M. Fetsuga
(74) *Attorney, Agent, or Firm*—Browdy and Neimark

(57) ABSTRACT

The inflow and drain fixture has a first housing section (7), which can be fixed to the back of a sidewall (2) of the tub (1) by means of a fastening ring (12) to be arranged on the tub side of the sidewall (2). An inflow fixture is furthermore provided, which is to be arranged on the tub side and connected to the above first housing section (7), said inflow fixture encompassing a second housing section (15) with a drain channel (15*c*), a drain opening (15*d*) and a turning handle (18) for operating the drain valve (9). The first housing section (7) is clamp-mountable with the fastening ring (12) independently from the second housing section (15) to the sidewall (2) in such a manner that the second housing section (15) can be taken off for cleaning purposes without detaching the fastening ring (12). The parts on the tub side can be very easily removed for cleaning purposes and the passages are then easily accessible for cleaning.

14 Claims, 1 Drawing Sheet

INFLOW AND DRAIN FIXTURE FOR BATHTUBS OR SHOWER TUBS

BACKGROUND OF THE INVENTION

1. Technical Field of the Invention

The present invention relates to an inflow and drain fixture for bathtubs or shower tubs having a first housing section that can be fixed to the back of a sidewall of the tub by means of a fastening ring to be arranged on the inside of the tub, and a connection for a water line, also an overflow opening, and an inflow fixture to be arranged on the inside of the tub and connected to said first housing section, said inflow fixture encompassing a second housing section with a drain channel, a drain opening and a turning handle for operating the drain valve.

2. Prior Art

Inflow and drain fixtures of this type are generally known. They serve as an overflow on one hand, and as an inflow on the other hand. As a third function, this fixture may also serve to open and close a tub drain. With fixtures of this type it is essential that they can be cleaned easily, safely and quickly. This is particularly important since dirt and also lime can accumulate unnoticed behind the rosette. This dirt build-up must be removed regularly for hygienical reasons. Lime deposits may interfere with the operability of the fixture.

For the fixture according to EP 0 731 222 A it has been proposed, in order to simplify the cleaning, that a component that combines the entire effective water outlet area of the inflow fixture be designed pivotable and separable. This component is mounted on a stationary modular unit. To perform a thorough cleaning, this modular unit too needs to be removed and cleaned. Only after this modular unit has been removed, do the passages for the overflow and the inflow become accessible as well. With this fixture, the above-mentioned stationary modular unit itself can be removed. However, this is comparatively difficult and cleaning personnel can hardly be expected to do so.

OBJECT AND SUMMARY OF THE INVENTION

The present invention is based on the object of creating a fixture according to the preamble that is even easier to clean, and which can be cleaned more thoroughly and is nevertheless economical to produce and easy to install. The inventive fixture shall furthermore permit installation in a building shell.

This object is met with a fixture according to the preamble in such a way that the first housing section can be clamped to the sidewall with the fastening ring independently from the second housing section in such a way that the second housing section can be taken off for cleaning purposes without detaching the fastening ring. In the inventive fixture the first housing section is clamped to the sidewall of the tub with the fastening ring independently from the second housing section. The second housing section has no fastening function and can be taken off without detaching the fastening ring. When the second housing section is taken off, the first housing section thus remains clamped to the sidewall with the fastening ring. Since there is no need to detach the fastening ring, the second housing section, which encompasses the effective water drain area, can be very easily taken off for cleaning purposes. After removing the second housing section, the openings for the overflow and the inflow are furthermore freely accessible on the tub side and can be cleaned and, for example, also flushed out. After the cleaning, the second housing section and the turning handle are put back on. The fastening ring remains in place during the entire cleaning process and holds the first housing section.

A significant advantage of the inventive fixture is also seen in the fact that the first housing section can be attached with the fastening ring for assembly in the building shell. The second housing section with the rosette is then attached after completion of the building shell. This becomes particularly easy if, according to an improvement of the invention, the second housing section is slipped on, preferably snapped on, in a manner so that it can be detached.

The fastening ring is preferably arranged behind the second housing section. The ring is preferably designed in the form of a flange and has a central sleeve-shaped threaded part. With this threaded part, the fastening ring can be screwed onto a central cylindrical part of the first housing section. According to an improvement of the invention, the second housing section engages into the fastening ring with a cylindrical projection.

According to an improvement of the invention, the second housing section is fixed to a central fixture axis with a slip-on type connection. The second housing section thus forms a drain element, which can be removed very easily and without detaching the fastening ring, and slipped back on after cleaning. According to an improvement of the invention, the second housing section is secured against twisting by means of a retention element.

Further advantageous characteristics will become apparent from the dependent claims and the following description, as well as from the drawing.

BRIEF DESCRIPTION OF THE DRAWINGS

An embodiment of the invention will be explained in greater detail below, based on the drawing in which.

DETAILED DESCRIPTION OF THE PREFERRED EMBODIMENT OF THE INVENTION

Figure 1:
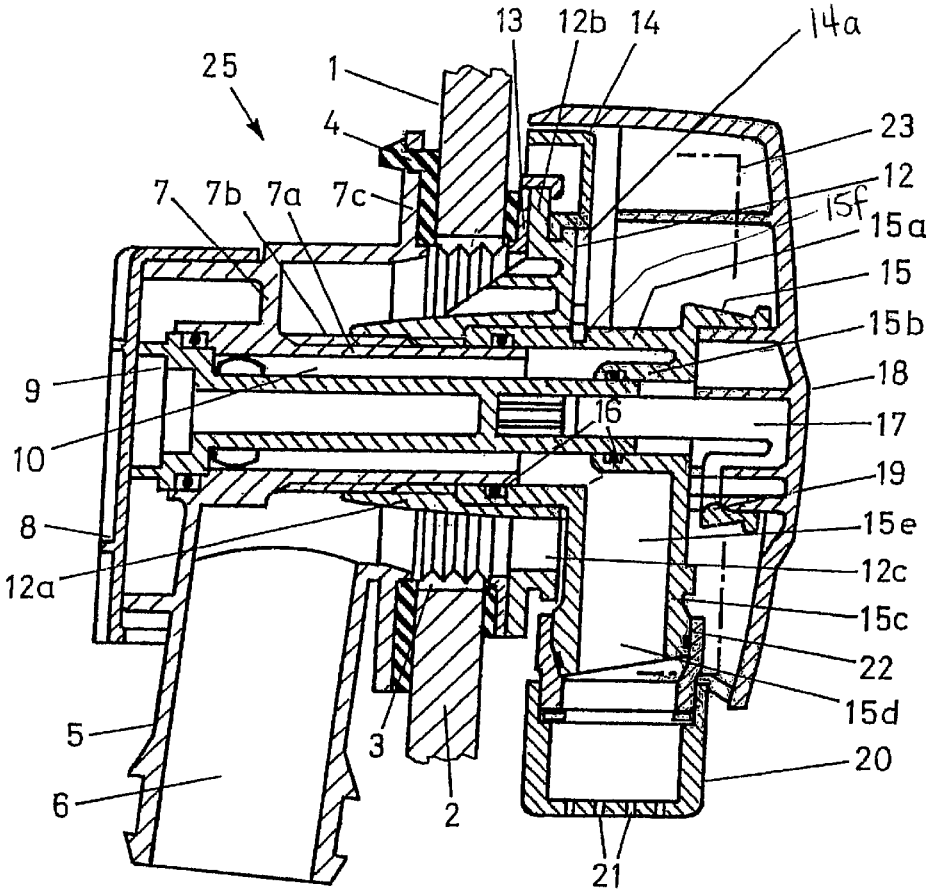
FIG. 1 shows a section through an inventive, assembled inflow and drain fixture.

In FIG. 1 the inflow and drain fixture 25 is removably clamped to a sidewall 2 of a tub, of which only a section is shown here. For sealing purposes the fixture 25 has a rubber collar 4, which is known per se, which is inserted into an opening 3 in the sidewall 2, and which is clamped to the sidewall 2 by means of a first housing section 7 and a fastening ring 12. The fastening ring 12 has a sliding ring 13 placed underneath on the tub side. The clamping is accomplished by means of a flange 7*c* of the first housing section 7 and a flange 12*b* of the fastening ring 12.

The first housing section 7 has an overflow nozzle 5, which is arranged on the back of the sidewall 2 and slipped onto a pipe not shown here. Overflowing water enters, on the inside of the tub, through an opening 12*c* of the fastening ring 12 and through the rubber collar 4 into the channel 6 of the overflow nozzle 5 and into the pipe not shown here.

For the inflow of water into the tub 1, the first housing section 7 has a connecting branch 11 onto which a supply line is to be connected, which is not shown here. Via a valve opening not shown here the water enters from the branch 11 into a supply channel 10 and from same into a channel 15*e* of the second housing section 15 and leaves same through an opening 15*d*. At the outlet end of this channel 15*e* an aerator

20, which has a number of relatively fine openings 21, is arranged in a manner so that it can be pivoted.

Figure 2:
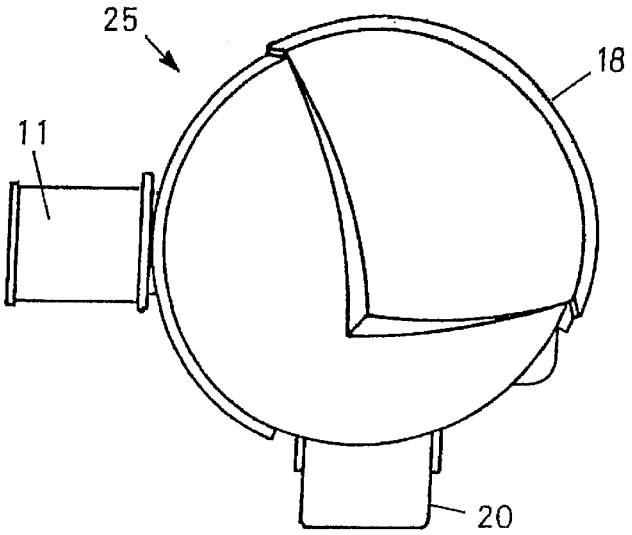
FIG. 2 shows a view of the fixture as shown in FIG. 1.

To operate the drain valve not shown here, the inflow valve has an axial body 9, which is housed centrally in the inflow channel 10 and connected via a driving feature 17 to the turning handle 18 in a manner so that it turns along with the handle. This turning handle 18 is a substantially shell-like rosette with an open bottom, as shown in FIG. 2, which covers the second housing section 15 from the front and sides. Only the aerator 20 or air jet is visible from the front and sides, as shown in FIG. 2. When the turning handle 18 is turned, the axial body 9 is turned and the drain valve is thus opened or closed.

The first housing section 7 has on its back a snapped-on lid 8, which positions the axial body 9. The first housing section 7 and the fastening ring 12 are, as mentioned above, connected to one another by a screw connection. For this purpose the first housing section 7 has an integral cylindrical part 7*a* with an exterior thread 7*b*, and the fastening ring 12 has a sleeve-shaped projection 12*a* with an interior thread. By screwing the fastening ring 12 onto the first housing section 7, the collar 4 is clamped against the wall 2 by the flanges 7*c* and 12*b*. The sliding ring 13 prevents the sleeve 4 from being dislocated during turning of the fastening ring 12.

The second housing section 15 has a cylindrical projection 15*a* and, within same, a second somewhat smaller, also cylindrical projection 15*b*. The larger projection 15*a* engages into the fastening ring 12 and encompasses the cylindrical projection 7*a* of the first housing section 7. As can be seen, the small projection 15*b* encompasses the axial body 9 at its tub-side end. Two sealing rings 16 seal the second housing section 15 against the first housing section 7. As can be seen, the second housing section 15 is thus slipped on in a removable manner. Locking cams or tabs not shown here may serve to removably connect the second housing section 15 to the first housing section 7 and/or to the fastening ring 12 with a snap-on connection.

The second housing section 15 is secured against twisting by means of a retention element 14. The cross-section of retention element 14 is shaped approximately like a horseshoe and slipped onto the flange 12*b* of the fastening ring 12 from the top so that projection 14*a* on retention element 14 extends into recess 15*f* on housing section 15 to preclude twisting between section 15 and fastening ring 12. The second housing section 15 could, of course, also be secured against twisting by different means.

The turning handle 18 is slipped onto the second housing section 15 in a removable manner and secured with locking cams 19. The turning handle 18 can thus be removed from the second housing section 15 by hand and later be slipped back on. The turning handle 18 can be turned relative to the second housing section 15. As mentioned above, the housing section 15 is secured against twisting by means of the retention element 14.

To mount the inflow and drain fixture 25 on the sidewall, the housing section 7 is first inserted with the rubber collar 4 from the back of the sidewall 2 into the opening 3, and from the other side of the sidewall 2 the fastening ring 12 is now screwed onto the first housing section 7. After completion of the building shell, the second housing section 15 is slipped on, and this second housing section 15 is subsequently secured against twisting by sliding on the retention element 14. Afterwards the turning handle 18 and the rosette are slipped or snapped onto the housing section 15. The inflow line can now be fastened to the branch 11 and the overflow line to the nozzle 5. Lastly, the aerator 20 is placed onto the second housing element 15. The sensitive parts on the tub side can thus be installed very easily after completion of the building shell.

For cleaning, the turning handle 18 is removed by hand from the second housing section 15. The retention element 14 is then removed from the fastening ring 12, and the second housing section 15 is also pulled off by hand. The removed parts can now be cleaned very easily. What is essential is, that the channel 10 and also the passage 12*c* are now easily accessible and can, therefore, be thoroughly cleaned. After cleaning, the above three parts 15, 14 and 18 can very easily be slipped back on. As a further part, a covering cap 23, which is only outlined here, may be arranged within the turning handle 18. This covering cap 23 has an open bottom and covers the sides of the cylindrical part 15*c* of the second housing section 15.

The foregoing description of the specific embodiments will so fully reveal the general nature of the invention that others can, by applying current knowledge, readily modify and/or adapt for various applications such specific embodiments without undue experimentation and without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. The means, materials, and steps for carrying out various disclosed functions may take a variety of alternative forms without departing from the invention.

Thus the expressions "means to . . ." and "means for . . .", or any method step language, as may be found in the specification above and/or in the claims below, followed by a functional statement, are intended to define and cover whatever structural, physical, chemical or electrical element or structure, or whatever method step, which may now or in the future exist which carries out the recited function, whether or not precisely equivalent to the embodiment or embodiments disclosed in the specification above, i.e., other means or steps for carrying out the same functions can be used; and it is intended that such expressions be given their broadest interpretation.

What is claimed is:

1. An inflow and drain fixture for a bath and shower tub each having a sidewall (2) comprising:

a first housing section (7) adapted to be fixed to an outside of the sidewall (2) by a fastening ring (12) adapted to engage an inside of the sidewall (2);

the first housing having a connection (11) for a water line, an overflow nozzle (6) and an inflow fixture (10) extending to the sidewall (2) and engaged to a second housing (15) adapted to be located at the inside of the sidewall (2);

the second housing having a drain channel (15*e*), a drain opening (15*d*) and a turning handle (18) for actuating a drain valve;

wherein the first housing section (7) and the fastening ring (12) are adapted to engage the sidewall (2) by clamping the sidewall (2) therebetween independent of the second housing which is engaged separately to the first housing to permit removal thereof for cleaning of the fixture without detaching the fastening ring (12) from the first housing (7).

2. A fixture according to claim 1, wherein the second housing section (15) is slipped on the first housing in a removable manner.

3. A fixture according to claim 1, wherein the second housing section (15) is snapped on the first housing in a removable manner.

4. A fixture according to claim 1 wherein the fastening ring (12) is screwed onto a central sleeve-shaped part **(7*a*) of the first housing section (7)**.

5. A fixture according to claim 1, wherein the second housing section (15) has an integral cylindrical part **(15*a*) which is inserted into the fastening ring (12)** for engagement.

6. A fixture according to claim 5, wherein the second housing section (15) is slipped onto an axial body (9) in the first housing which operates the drain valve.

7. A fixture according to claim 1, wherein, a retention element (14) is arranged behind the handle part (18) that prevents the second housing section (15) from twisting on the fastening ring (12).

8. A fixture according to claim 7, wherein the retention element (14) is fixed to the fastening ring (12).

9. A fixture according to claim 8, wherein the retention element (14) is snapped onto the fastening ring (12).

10. A fixture according to claim 1, wherein the second housing section (15) has a radially outbound stationary drain channel **(15*c*), and an aerator (20) pivotable engaged in an area of a drain opening (15*d*)** from the drain channel.

11. A fixture according to claim 9, wherein a covering cap (23) is placed upon the fastening ring (12).

12. A fixture according to claim 1, wherein the fastening ring (12) has a central tube-shaped threaded part **(12*a*) and a clamping part (12*b*)** that extends radially to the outside.

13. A fixture according to claim 1, wherein the fastening ring (12) between the second housing section (15) and the first housing (7) on an inside of the second housing.

14. A fixture according to claim 1, wherein the fastening ring has an overflow opening **(12*c*) outside of the second housing which communicates with the overflow nozzle (6)**.

* * * * *